US009393480B2

(12) United States Patent
Gibby

(10) Patent No.: US 9,393,480 B2
(45) Date of Patent: Jul. 19, 2016

(54) BASEBALL GLOVE WITH FLOATING PAD FIT ADJUSTMENT

(75) Inventor: Garth Roy Gibby, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 858 days.

(21) Appl. No.: 13/432,459

(22) Filed: Mar. 28, 2012

(65) Prior Publication Data

US 2013/0254972 A1 Oct. 3, 2013

(51) Int. Cl.
*A63B 71/14* (2006.01)

(52) U.S. Cl.
CPC ..... *A63B 71/143* (2013.01); *A63B 2225/09* (2013.01)

(58) Field of Classification Search
CPC .... A63B 71/14; A63B 71/141; A63B 71/143; A63B 71/145; A63B 71/146; A63B 71/148
USPC ..... 2/16, 18, 19, 161.1
See application file for complete search history.

(56) References Cited

U.S. PATENT DOCUMENTS

| | | | | |
|---|---|---|---|---|
| 811,389 A | | 1/1906 | Ferry | |
| 2,434,171 A | | 1/1948 | Latina | |
| 3,994,024 A | * | 11/1976 | Bates | 2/19 |
| 5,214,798 A | | 6/1993 | McLaughlin | |
| 5,367,707 A | * | 11/1994 | Murai | 2/19 |
| 5,448,775 A | * | 9/1995 | Yamada et al. | 2/19 |
| 5,457,819 A | * | 10/1995 | Aoki | 2/19 |
| 2009/0007307 A1 | * | 1/2009 | Le et al. | 2/19 |

FOREIGN PATENT DOCUMENTS

| | | |
|---|---|---|
| CN | 201684389 U | 12/2010 |
| JP | H10211310 A | 8/1998 |

OTHER PUBLICATIONS

International Search Report and Written Opinion of PCT/US2013/034430 filed Mar. 28, 2013.
European Supplementary Search Report dated Apr. 24, 2015 in Application No. 13769495.6, 7 pages.

* cited by examiner

*Primary Examiner* — Shaun R Hurley
*Assistant Examiner* — Andrew W Sutton
(74) *Attorney, Agent, or Firm* — Shook, Hardy & Bacon, L.L.P.

(57) ABSTRACT

A closed-back athletic glove capable of receiving a human hand is provided. The glove comprises an exterior glove having a wrist back portion corresponding approximately to the area where the back of the user's hand meets the user's wrist. A wrist strap is connected to the interior surface of the exterior glove shell at a first attachment point. The wrist strap runs from the first attachment point along a portion of the interior surface of the wrist back portion to a second attachment point. An adjustment pad is connected to the wrist strap such that when the glove is worn by the user, the adjustment pad is between the wrist strap and the user's hand and such that when the wrist strap is tightened, the wrist strap exerts a force on the adjustment pad that tightens the adjustment pad against the user's hand.

20 Claims, 5 Drawing Sheets

BASEBALL GLOVE WITH FLOATING PAD FIT ADJUSTMENT

CROSS-REFERENCE TO RELATED APPLICATIONS

Not applicable.

STATEMENT REGARDING FEDERALLY SPONSORED RESEARCH OR DEVELOPMENT

Not applicable.

TECHNICAL FIELD

The present invention relates to athletic gloves. More particularly, the present invention relates to closed-back baseball and softball gloves with a floating pad for an enhanced, adjustable fit.

BACKGROUND

Athletic gloves of various types are widely used in sports to improve performance. In sports such as baseball and softball, players typically wear a glove on the non-throwing hand for catching fly balls, throws, and line drives and for fielding ground balls. Gloves are typically made of a durable material such as leather. Baseball and softball gloves can have either an "open back" or a "closed back." In an open-back design, a sizeable portion of the back of the user's hand is often visible, and when the glove's wrist strap is undone, the portions of the glove that come together at the wrist strap can usually be pulled apart. In a closed-back design, the portion of the glove around the back of the user's hand is typically either a solid piece or several pieces connected together that cannot be pulled apart in the course of normal use. A finger hole is often included for a user so that the user may have the index finger on the outside of the glove if desired.

The wrist strap on an open-back glove typically brings two portions of the glove closer to each other to achieve a snug fit around the user's hand. Bunching is limited because the back of the glove around the wrist area typically consists of two pieces each having freedom of movement such that they can be brought together and overlapped.

In a closed-back design, however, a conventional wrist strap is difficult to implement. The portions of the back of the glove around the wrist do not have freedom of movement in a closed-back design, and cinching this area of the glove to achieve a tighter fit causes uncomfortable bunching. Additionally, a significant amount of force is required to bunch the leather, making adjusting the fit quickly more difficult than in an open-back design.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

A closed-back athletic glove capable of receiving a human hand is provided. The glove comprises an exterior glove shell having a palm-side portion, a primary back portion, and a wrist back portion that form index, middle, ring, and pinky finger sheaths, a thumb sheath, and an opening capable of receiving a human hand. The opening is located opposite the four finger sheaths and corresponds approximately to the wrist of a user when the glove is worn by the user with fingers of the user extending within the four finger sheaths and the thumb of the user extending within the thumb sheath. The wrist back portion corresponds approximately to the area where the back of the user's hand meets the user's wrist. A glove webbing is connected to and extends between the thumb sheath and the index finger sheath. A wrist strap is connected to the interior surface of the exterior glove shell at a first attachment point. The wrist strap runs from the first attachment point along a portion of the interior surface of the wrist back portion to a second attachment point. An adjustment pad is connected to the wrist strap such that when the glove is worn by the user, the adjustment pad is between the wrist strap and the user's hand and such that when the wrist strap is tightened, the wrist strap exerts a force on the adjustment pad that tightens the adjustment pad against the user's hand.

BRIEF DESCRIPTION OF THE DRAWINGS

The present invention is described in detail below with reference to the attached drawing figures, wherein.

DETAILED DESCRIPTION

In closed-back gloves used in baseball and softball, a conventional wrist strap is difficult to implement without uncomfortable bunching that can adversely affect a player's performance. The present invention provides a closed-back athletic glove including a novel wrist strap and adjustment pad that allows the glove to be tightened against a user's hand without bunching the exterior shell of the glove. Examples of the present invention are illustrated in FIGS. 1-9.

Figure 1:
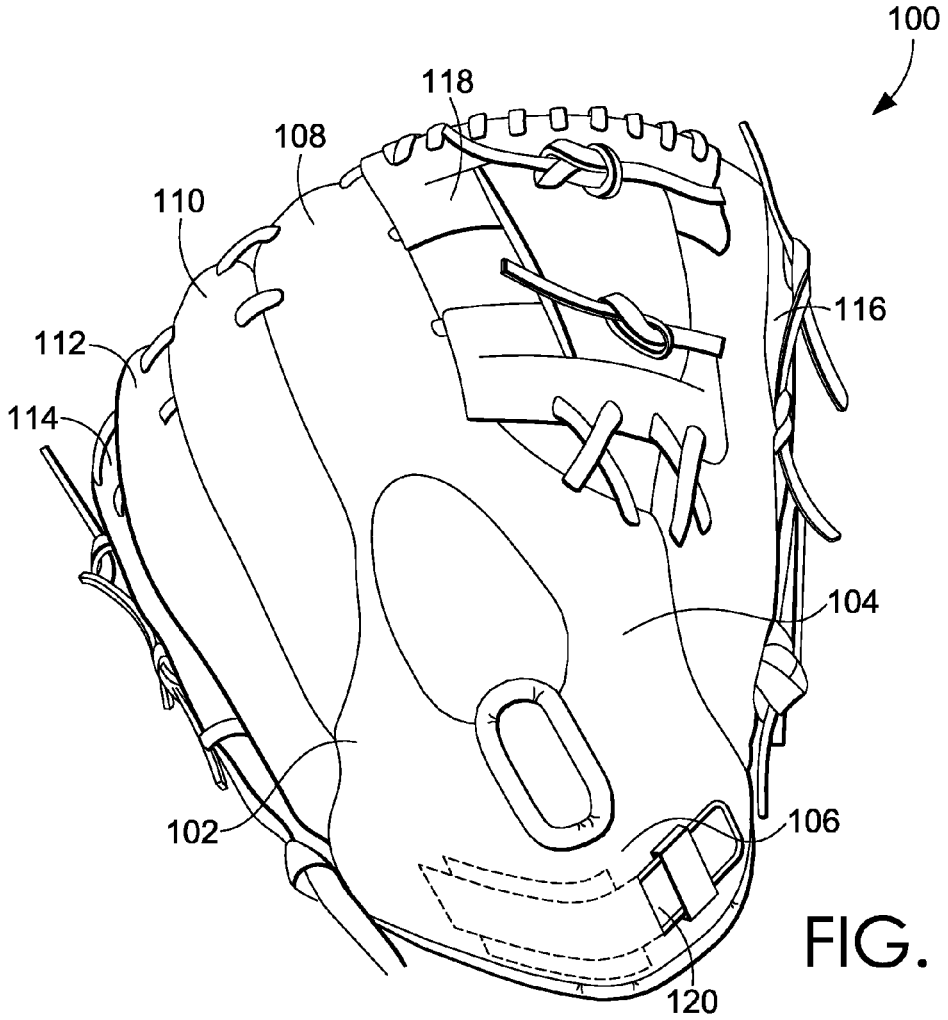
FIG. 1 is a perspective view of the back portion of an exemplary athletic glove with an adjustment pad connected to the wrist strap in accordance with an example of the present invention.
Figure 2:
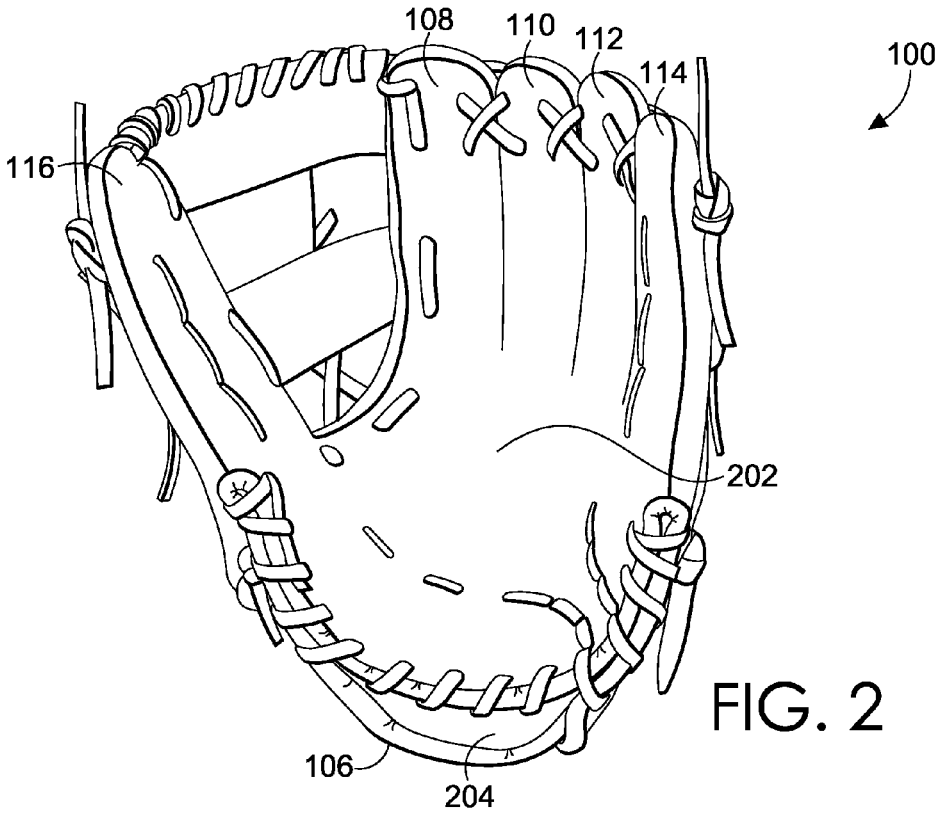
FIG. 2 is a perspective view of the palm-side portion of the exemplary athletic glove of FIG. 1.

FIG. 1 illustrates a closed-back athletic glove 100. Glove 100 comprises exterior glove shell 102. Exterior glove shell 102 is made of a durable material such as leather or synthetic leather. Exterior glove shell 102 has a palm-side portion (not shown in FIG. 1), a primary back portion 104, and a wrist back portion 106 that form index finger sheath 108, middle finger sheath 110, ring finger sheath 112, pinky finger sheath 114, thumb sheath 116, and an opening capable of receiving a human hand (not shown in FIG. 1). FIG. 2 illustrates palm-side portion 202 and opening 204 capable of receiving a human hand that are not visible in FIG. 1. Opening 204 is located opposite finger sheaths 108, 110, 112, and 114 and adjacent to wrist back portion 106 when glove 100 is worn by a user with fingers of the user extending within finger sheaths 108, 110, 112, and 114 and the thumb of the user extending within thumb sheath 116.

Returning now to FIG. 1, wrist back portion 106 corresponds approximately to the area where the back of the user's hand meets the user's wrist. Wrist back portion 106 encompasses the area where a wrist strap is conventionally located in an open-back glove. Glove webbing 118 connects to and extends between index finger sheath 108 and thumb sheath 116. Glove webbing 118 may comprise one or more pieces of material connected to be substantially solid, woven, or otherwise interlocked or overlaid. Glove webbing 118 creates a "pocket" in glove 100 that is used to catch, field, and or hold a ball.

Figure 3:
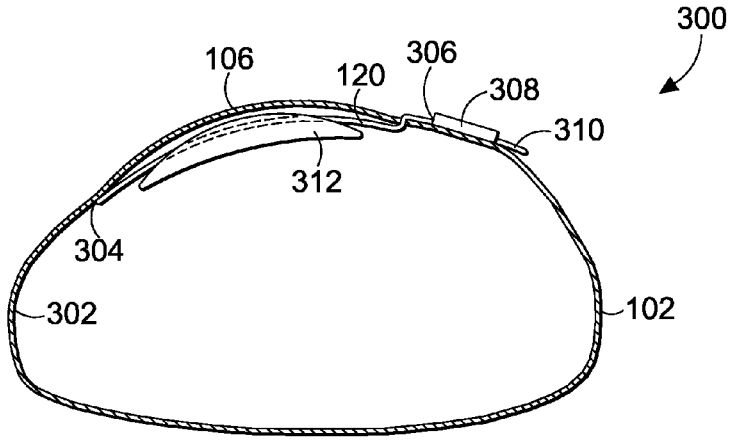
FIG. 3 is a partial cross-sectional view of the exemplary athletic glove of FIG. 1.
Figure 5:
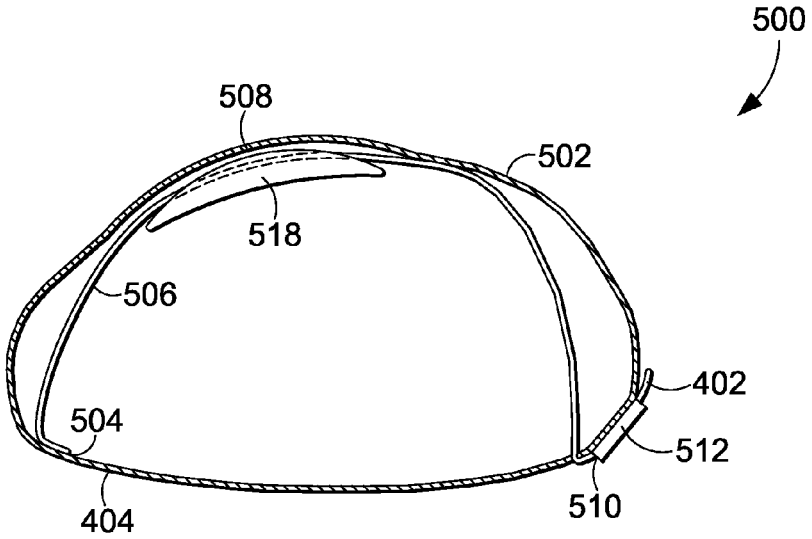
FIG. 5 is a partial cross-sectional view of the exemplary athletic glove of FIG. 4.
Figure 7:
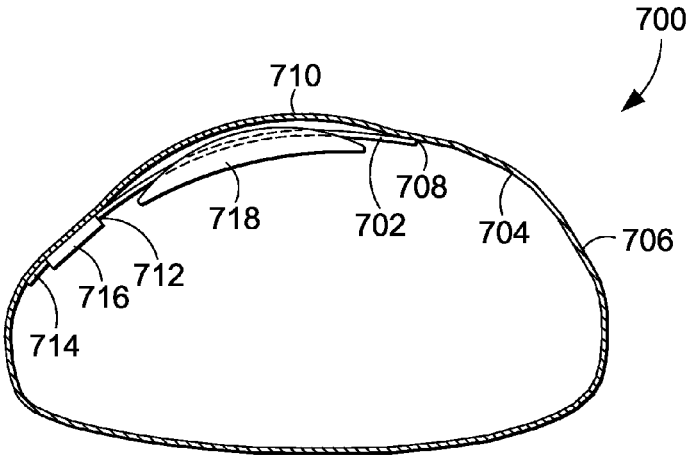
FIG. 7 is a partial cross-sectional view of the exemplary athletic glove of FIG. 6.
Figure 9:
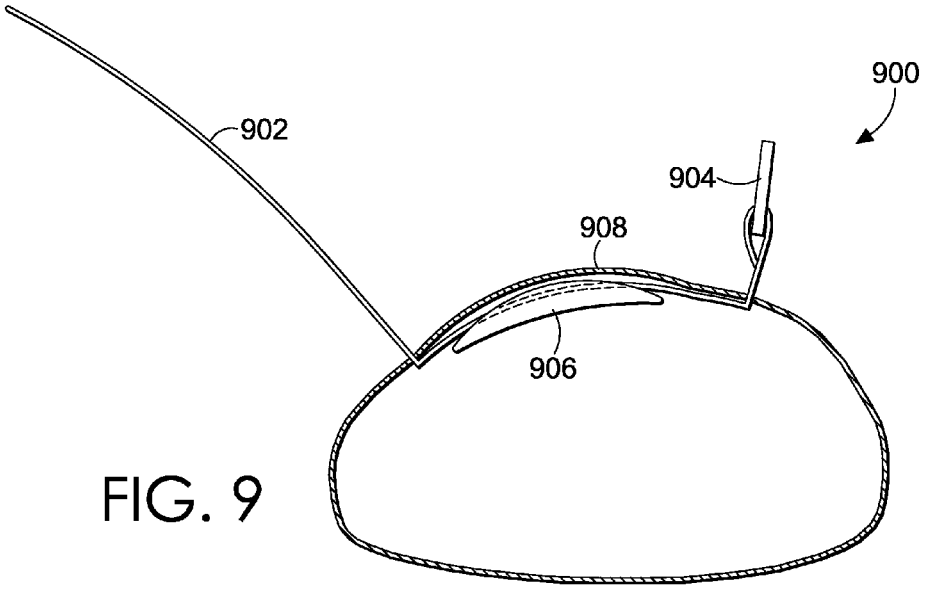
FIG. 9 is a partial cross-sectional view of the exemplary athletic glove of FIG. 8.

Wrist strap 120 is largely on the interior of glove 100 (as indicated by the dotted line in FIG. 1). Wrist strap 120 is illustrated in more detail in FIG. 3. FIG. 3 illustrates a simplified cross section 300 of glove 100. Exterior glove shell 102 is visible, but it is to be appreciated that other middle and/or interior layers that may be present in particular examples are omitted in FIG. 3 for clarity. Wrist strap 120 is connected to the interior surface 302 of exterior glove shell 102 at a first attachment point 304. As used in this application, connection to an attachment point can be accomplished through a variety of techniques, including but not limited to buckles or fasteners, adhesive, sewing, or stitching. Wrist strap 120 runs from first attachment point 304 along a portion of interior surface 302 of wrist back portion 106 to a second attachment point 306. First attachment point 304 and second attachment point 306 may be a variety of locations, as is illustrated in the examples of FIGS. 5, 7, and 9.

In FIG. 3, first attachment point 304 is on the interior surface 302 of wrist back portion 106, and second attachment point 306 is on the exterior surface of exterior glove shell 102 such that wrist strap 120 runs from interior surface 302 of exterior glove shell 102, along the portion of interior surface 302 of wrist back portion 106, and out through exterior glove shell 102 on the thumb-sheath side of glove 100. As shown in FIG. 3, second attachment point 306 is at buckle 308. Strap end 310 extends through buckle 308. A user can tighten strap 120 by pulling on strap end 310. Buckle 308 may be a variety of buckles or similar hardware. The visual representation of buckle 308 is intended to represent that some type of fastening hardware is present. Buckle 308 may additionally be any structure that allows strap end 310 to be pulled away from first attachment point 304 to tighten and maintain the fit of glove 100.

In one example, buckle 308 contains an angled piece internal to buckle 308 and extending diagonally from the top or bottom of buckle 308 toward strap end 310 such that when a user pulls on strap end 310 to tighten, strap 120 moves easily, but when a user attempts to loosen strap 120, the movement of strap 120 out of buckle 308 and toward first attachment point 304 causes strap 120 to catch on the internal angled piece and prevents loosening of strap 120.

Adjustment pad 312 is connected to wrist strap 120 such that when glove 100 is worn by the user, adjustment pad 312 is between wrist strap 120 and the user's hand and such that when wrist strap 120 is tightened, wrist strap 120 exerts a force on adjustment pad 312 that tightens adjustment pad 312 against the user's hand. In FIG. 3, wrist strap 120 runs through adjustment pad 312 (as indicated by the dashed lines) such that wrist strap 120 can slide through adjustment pad 312. Thus, because wrist strap 120 runs through adjustment pad 312, when wrist strap 120 is tightened, wrist strap 120 moves independently of adjustment pad 312.

As can be seen in FIG. 3, adjustment pad 312 is "floating" and is not attached directly to exterior glove shell 102. Pulling on strap end 310 causes strap 120 to push down on adjustment pad 312 and tighten against the user's hand without also causing exterior glove shell 102 to bunch. Thus, in contrast to an open-back glove in which two portions of the exterior glove shell are brought together to tighten the glove, closed-back glove 100 can be tightened around a user's hand without tightening exterior glove shell 102 and causing uncomfortable bunching that may adversely affect performance.

Although FIG. 3 illustrates wrist strap 120 running through adjustment pad 312, adjustment pad 312 may be connected to wrist strap 120 in other ways. For example, adjustment pad 312 may be non-moveably affixed to wrist strap 120 using adhesive, sewing, stitching, or other techniques. In other examples, adjustment pad 312 may have a sleeve or loop on top through which wrist strap 120 slides. In one example, adjustment pad 312 is made of leather or synthetic leather. In other examples, adjustment pad 312 is thicker in the center and tapers toward pinky sheath 114 and thumb sheath 116. When glove 100 is worn by a user, adjustment pad 312 may be in direct contact with the back of the user's hand. In other examples, an interior liner may be present between adjustment pad 312 and the back of the user's hand.

Glove 100 is designed to receive a left hand. Gloves designed to receive a right hand are also envisioned and within the scope of the present invention. For simplicity, only a glove designed to receive a left hand is shown in the drawings. In some examples, glove 100 is a mitt such as a baseball or softball catcher's or first-baseman's mitt. Gloves typically have finger sheaths such as sheaths 108, 110, 112 and 114 that are clearly visible as distinct finger sheaths and are connected together at one or a few points. Mitts, in contrast, may not have distinct finger sheaths that are clearly visible.

The novel wrist strap and adjustment pad for a closed-back glove described in this application can be implemented in a variety of ways using different attachment points, pad geometries, strap end locations, and other variations. Some alternative examples are illustrated in FIGS. 4-9.

Figure 4:
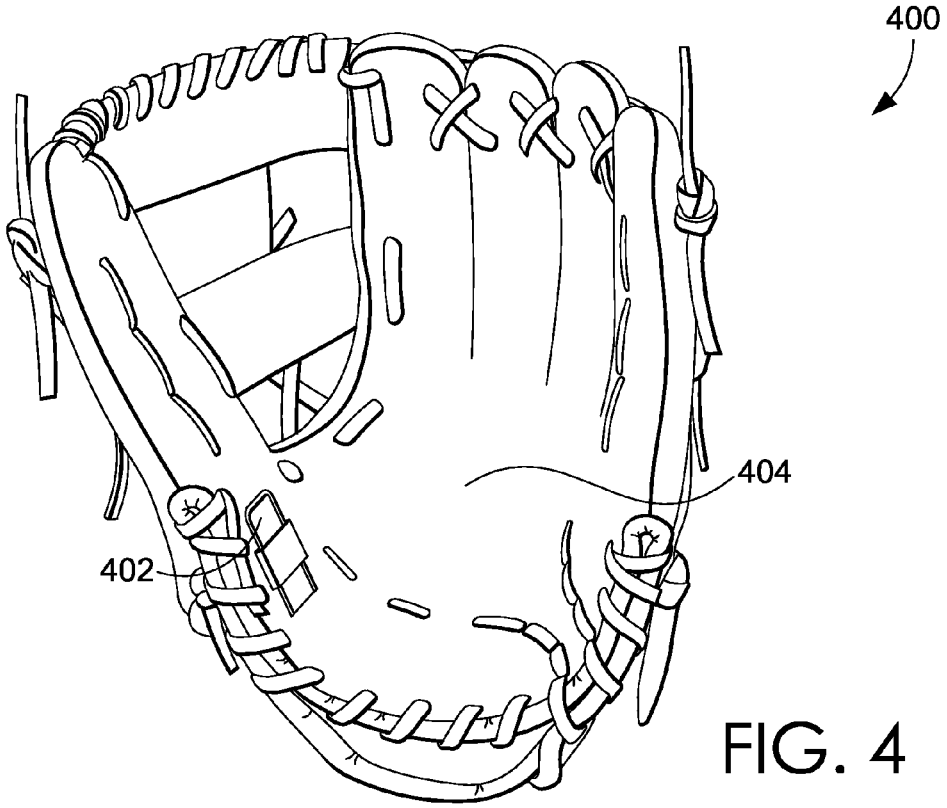
FIG. 4 is a perspective view of the palm-side portion of an exemplary athletic glove with an adjustment pad connected to the wrist strap in accordance with an example of the present invention in which the wrist strap runs out through the exterior glove shell on the palm-side portion.

FIG. 4 illustrates a closed-back athletic glove 400. Strap end 402 extends from the thumb-sheath side of palm-side portion 404 of glove 400. In glove 400, a wrist strap is accessible from palm-side portion 404 of glove 400 rather than from the wrist back portion as in glove 100 shown in FIGS. 1-3. Various players may have preferred motions for tightening a glove, and examples of the present invention include strap ends located at various positions to provide players with a glove that best suits their needs.

FIG. 5 is a simplified cross section 500 of glove 400. Exterior glove shell 502 is visible, but it is to be appreciated that other middle and/or interior layers that may be present in particular examples are omitted in FIG. 5 for clarity. In glove 400, first attachment point 504 is on the interior surface of palm-side portion 404. Wrist strap 506 runs from first attachment point 504, along the interior surface of wrist back portion 508, out through exterior glove shell 502 and to second attachment point 510. Second attachment point 510 is thus on the thumb-sheath side of exterior glove shell 502 of glove 400. In some examples, second attachment point 510 may be located on the interior surface of palm-side portion 404.

Similar to second attachment point 306 of FIG. 3, second attachment point 510 is at buckle 512. Strap end 402 extends through buckle 512. A user can tighten strap 506 by pulling on strap end 402. Adjustment pad 514 is connected to wrist strap 506 such that when glove 400 is worn by the user, adjustment pad 514 is between wrist strap 506 and the user's hand and such that when wrist strap 506 is tightened, wrist strap 506 exerts a force on adjustment pad 514 that tightens adjustment pad 514 against the user's hand. Similar to wrist strap 120 and adjustment pad 312 in FIG. 3, wrist strap 506 runs through adjustment pad 514 (as indicated by the dashed lines) such that wrist strap 506 can slide along and move independently from adjustment pad 514. Pulling on strap end 402 causes strap 506 to push down on adjustment pad 514 and tighten against the user's hand without also causing exterior glove shell 502 to bunch.

Figure 6:
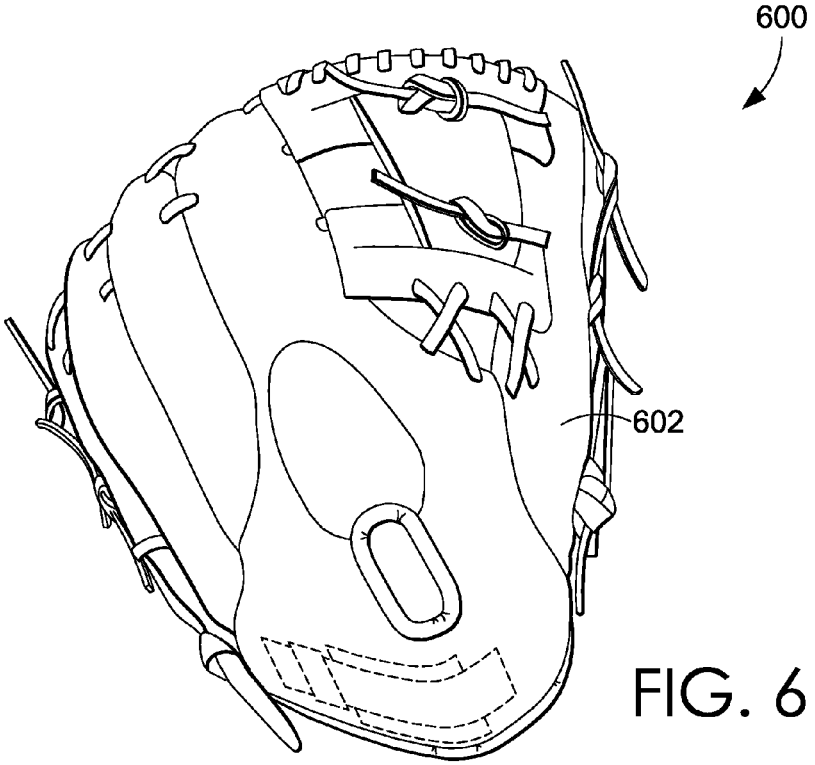
FIG. 6 is a perspective view of the back portion of an exemplary athletic glove with an adjustment pad connected to the wrist strap in accordance with an example of the present invention in which the wrist strap does not run out through the exterior glove shell.

FIGS. 6 and 7 illustrate a closed-back athletic glove 600 in which the wrist strap is not visible on the exterior surface of exterior glove shell 602. FIG. 7 illustrates a simplified cross section 700 of glove 600. Wrist strap 702 is connected to interior surface 704 of the exterior glove shell 706 at a first attachment point 708. Wrist strap 702 runs from first attachment point 708 along a portion of interior surface 704 of wrist back portion 710 to a second attachment point 712 on interior surface 704 of exterior glove shell 706. Strap end 714 extends through buckle 716. An adjustment pad 718 is connected to wrist strap 702 such that when glove 600 is worn by the user, adjustment pad 718 is between wrist strap 702 and the user's hand and such that when wrist strap 702 is tightened, wrist strap 702 moves independently of adjustment pad 718 and exerts a force on adjustment pad 718 that tightens adjustment pad 718 against the user's hand. Thus, glove 600 provides a strap and adjustment pad that are contained on the inside of glove 600. Such an arrangement ensures that strap end 714 is out of the way and does not interfere with a player's performance.

Figure 8:
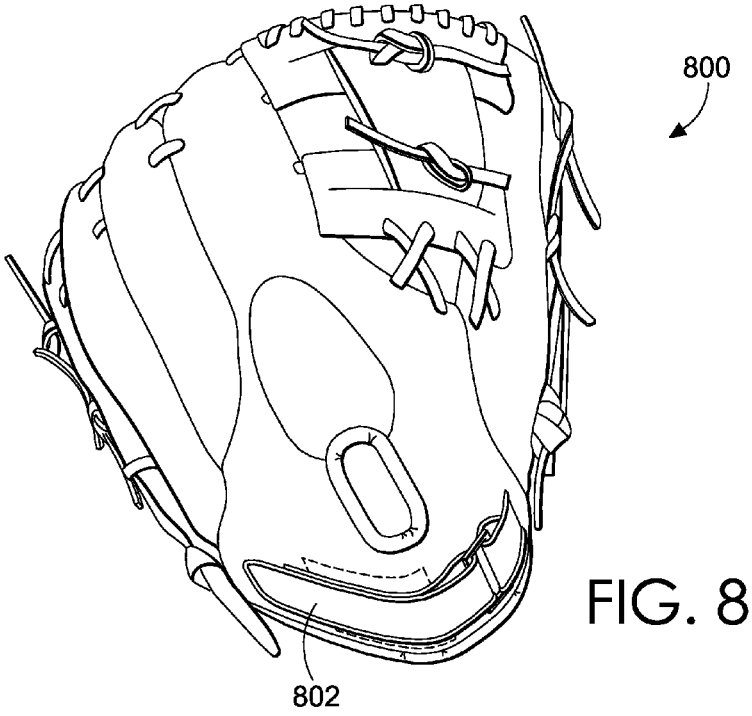
FIG. 8 is a perspective view of the back portion of an exemplary athletic glove with an adjustment pad connected to the wrist strap in accordance with an example of the present invention in which the wrist strap runs out through the exterior glove shell in two places on the back portion.

FIGS. 8 and 9 illustrate a closed-back athletic glove 800 having a strap 802 that visibly resembles an open-back strap. FIG. 9 illustrates a simplified cross section of glove 800. Although strap 802 includes a primary strap portion 902 and a strap buckle 904, unlike a conventional open-back strap in which two pieces of the exterior glove shell are brought together, tightening strap 802 of glove 800 instead pushes down on adjustment pad 906 without bunching of exterior glove shell 908.

The present invention encompasses baseball gloves, softball gloves, tee-ball gloves, and other gloves used to field or catch objects.

The present invention has been described in relation to particular examples, which are intended in all respects to be illustrative rather than restrictive. Alternative examples will become apparent to those of ordinary skill in the art to which the present invention pertains without departing from its scope.

From the foregoing, it will be seen that this invention is one well adapted to attain all the ends and objects set forth above, together with other advantages which are obvious and inherent to the system and method. It will be understood that certain features and subcombinations are of utility and may be employed without reference to other features and subcombinations. This is contemplated by and is within the scope of the claims.

Having thus described the invention, what is claimed is:

1. A closed-back athletic glove capable of receiving a human hand, the athletic glove comprising:

an exterior glove shell having a palm-side portion, a primary back portion, and a wrist back portion that form index, middle, ring, and pinky finger sheaths, a thumb sheath, and an opening capable of receiving a human hand, the opening located opposite the four finger sheaths and adjacent to the wrist back portion;

a glove webbing connected to and extending between the thumb sheath and the index finger sheath;

a wrist strap connected to an interior surface of the exterior glove shell at a first attachment point, the wrist strap running from the first attachment point along a portion of the interior surface of the wrist back portion to a second attachment point, wherein the wrist strap includes a free end, the second attachment point being positioned between the free end and the first attachment point; and an adjustment pad slidably connected to the wrist strap and disconnected from the interior surface of the exterior glove shell, the wrist strap extending through the adjustment pad, such that, when the free end is pulled, the wrist strap exerts a force on the adjustment pad that tightens the adjustment pad by the wrist strap sliding through the adjustment pad and cinching the second attachment point towards the first attachment point.

2. The closed-back athletic glove of claim 1, wherein the adjustment pad is connected to the wrist strap such that when the wrist strap is tightened, the wrist strap moves independently of the adjustment pad.

3. The closed-back athletic glove of claim 1, wherein the first attachment point is on the interior surface of the wrist back portion.

4. The closed-back athletic glove of claim 1, wherein the first attachment point is on the interior surface of the palm-side portion.

5. The closed-back athletic glove of claim 1, wherein the second attachment point is on the interior surface of the wrist back portion.

6. The closed-back athletic glove of claim 1, wherein the second attachment point is on the interior surface of the palm-side portion.

7. The closed-back athletic glove of claim 1, wherein the second attachment point is on the exterior surface of the exterior glove shell such that the wrist strap runs from the interior surface of the exterior glove shell, along the portion of the interior surface of the wrist back portion, and out through the exterior glove shell.

8. The closed-back athletic glove of claim 7, wherein the wrist strap runs out through the exterior glove shell on the pinky-sheath side of the glove.

9. The closed-back athletic glove of claim 7, wherein the wrist strap runs out through the exterior glove shell on the thumb-sheath side of the glove.

10. The closed-back athletic glove of claim 1, wherein the adjustment pad is thicker in the center of the pad and tapers toward the pinky sheath and thumb sheath.

11. A closed-back athletic glove capable of receiving a human hand, the athletic glove comprising:

an exterior glove shell having a palm-side portion, a primary back portion, and a wrist back portion that form index, middle, ring, and pinky finger sheaths, a thumb sheath, and an opening capable of receiving a human hand, the opening located opposite the four finger sheaths and adjacent to the wrist back portion;

a glove webbing connected to and extending between the thumb sheath and the index finger sheath;

a wrist strap connected to the interior surface of the exterior glove shell at a first attachment point, the wrist strap running from the first attachment point, along a portion of the interior surface of the wrist back portion, out through the exterior glove shell, and to a second attachment point on the exterior surface of the exterior glove shell, the second attachment point including a buckle having an angled member and the wrist strap having a free end, the buckle being positioned between the free end and the first attachment point; and an adjustment pad connected to the wrist strap in a middle portion of the wrist strap between the first attachment point and the buckle, wherein the angled member catches the wrist strap to impede strap movement when the middle portion is pulled towards the first attachment point, and wherein the angled member does not catch the wrist strap when the wrist strap is tightened by pulling on the free end, the wrist strap moving independently of the adjustment pad.

12. The closed-back athletic glove of claim 11, wherein the wrist strap runs out through the exterior glove shell on the pinky-sheath side of the glove.

13. The closed-back athletic glove of claim 11, wherein the wrist strap runs out through the exterior glove shell on the thumb-sheath side of the glove.

14. The closed-back athletic glove of claim 11, wherein the first attachment point is on one of the interior surface of the wrist back portion or the interior surface of the palm-side portion.

15. A closed-back baseball glove capable of receiving a human hand, the baseball glove comprising:

an exterior glove shell having a palm-side portion, a primary back portion, and a wrist back portion that form index, middle, ring, and pinky finger sheaths, and a thumb sheath, and that at least partially encase a hand-receiving cavity, the wrist back portion at least partially defining an opening that provides access to the hand-receiving cavity, the opening located opposite the four finger sheaths and adjacent to the wrist back portion;

a glove webbing connected to and extending between the thumb sheath and the index finger sheath;

a buckle affixed to an interior surface of the wrist back portion of the exterior glove shell and positioned within the hand-receiving cavity;

a wrist strap connected to the interior surface of the exterior glove shell at a first attachment point, the wrist strap extending from the first attachment to a wrist-strap free end, wherein the wrist-strap free end is threaded through the buckle to attach the wrist strap to the interior surface of the exterior glove shell at a second attachment point, wherein the wrist-strap free end is retained within the hand receiving cavity when the wrist-strap free end is threaded through the buckle; and an adjustment pad connected to the wrist strap such that when the glove is worn by the user the adjustment pad is between the wrist strap and the user's hand and such that when the wrist strap is tightened, the wrist strap moves independently of the adjustment pad and exerts a force on the adjustment pad that tightens the adjustment pad.

16. The closed-back athletic glove of claim 15, wherein both the first and second attachment points are on the interior surface of the wrist back portion.

17. The closed-back athletic glove of claim 15, wherein both the first and second attachment points are on the interior surface of the palm-side portion.

18. The closed-back athletic glove of claim 15, wherein the buckle is positioned to align with the pinky finger sheath.

19. The closed-back athletic glove of claim 15, wherein the adjustment pad is slidably connected to the wrist strap and disconnected from the interior surface of the exterior glove shell, and wherein the wrist strap exerts the force on the adjustment pad by cinching the buckle towards the first attachment point.

20. The closed-back athletic glove of claim 10, wherein the pad includes a shell-facing surface and a hand-facing surface, and wherein the shell-facing surface includes a convex curvature and the hand-facing surface is substantially planar.

* * * * *